US006247966B1

(12) United States Patent
Klein et al.

(10) Patent No.: US 6,247,966 B1
(45) Date of Patent: Jun. 19, 2001

(54) ELECTRICAL CONNECTOR WITH EXPOSED MOLDED LATCHES

(75) Inventors: David Allen Klein, Kernersville; Billy Hayes Simpson, Yadkinville, both of NC (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 09/411,511

(22) Filed: Oct. 4, 1999

(51) Int. Cl.[7] ..... H01R 13/40
(52) U.S. Cl. ..... 439/595; 439/752
(58) Field of Search ..... 439/595, 744, 439/752

(56) References Cited

U.S. PATENT DOCUMENTS 4,891,021 1/1990 Hayes et al. ..... 439/599
4,984,998 1/1991 Duncan et al. ..... 439/352
5,322,448 6/1994 Hahn ..... 439/157
5,554,052 * 9/1996 Saijo et al. ..... 439/595

* cited by examiner

*Primary Examiner*—Neil Abrams
*Assistant Examiner*—Phoung Dinh

(57) ABSTRACT

An electrical connector assembly includes an electrical connector 2 which can be positioned in a shroud 70 that can be actuated by a lever 72 to mate with a pin header connector 4. Contact terminals 10 located in cavities 30 in a molded housing 20 are held in place by primary latching members that comprise molded deflectable cantilever latches 50. The latches 50 are part of external housing faces 28. During insertion and removal of the contacts 10, the latches are outwardly deflected. A stop shoulder 54 on the front of each latch 50 is opposed to a fixed shoulder 40 to prevent excess latch deflection and overstressing of the plastic. The latch stop shoulders 54 are formed on inner corners of a frame 60 located on the distal or front end 52 of the cantilever latches 50 which define a portion of the housing mating face.

21 Claims, 7 Drawing Sheets

FIG. 11
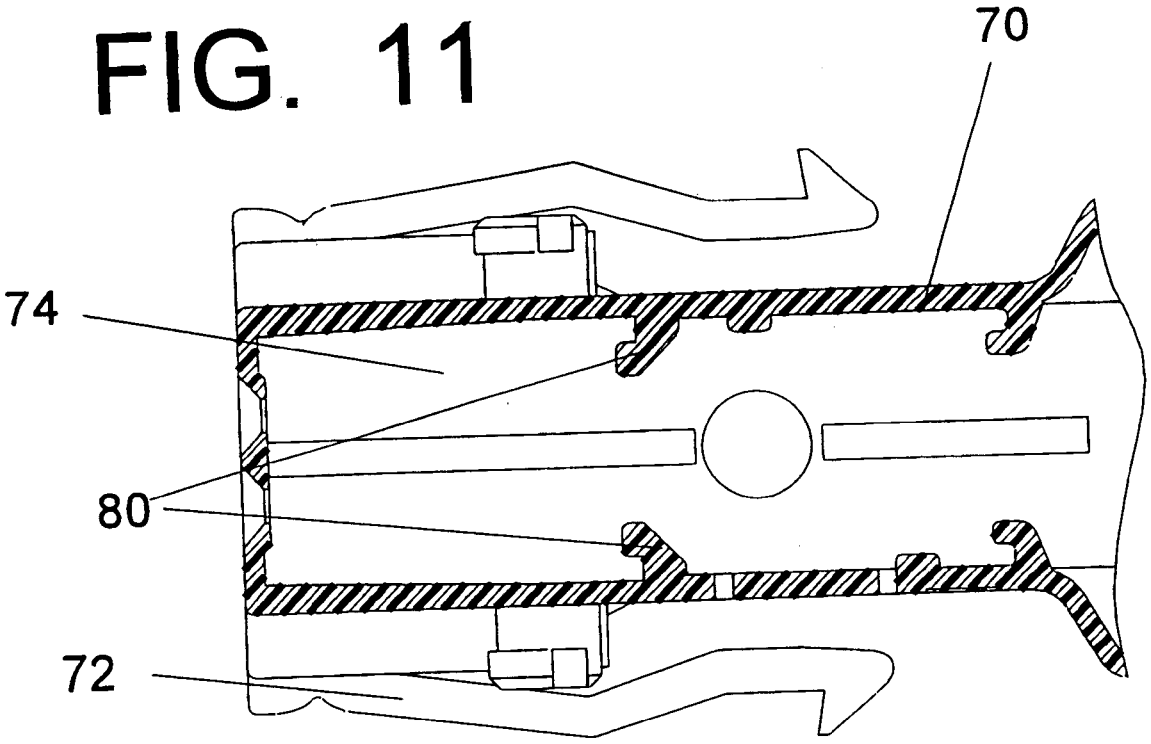
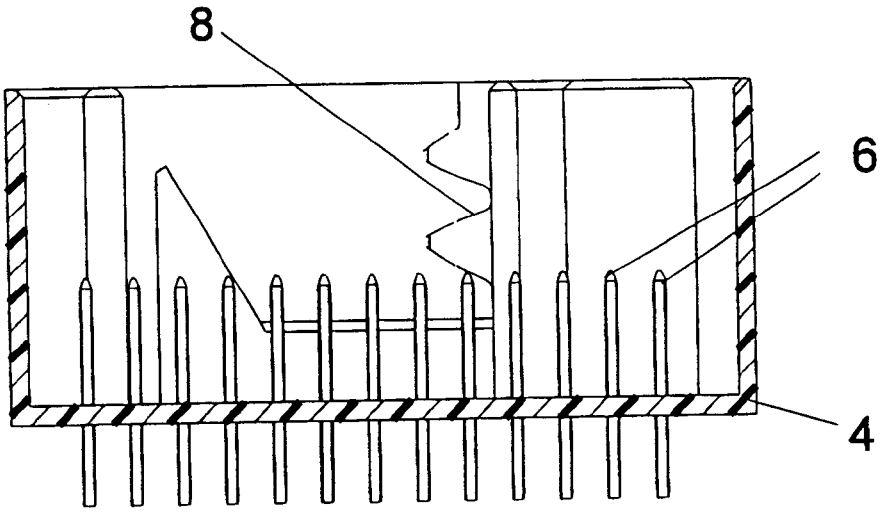
FIG. 12

ELECTRICAL CONNECTOR WITH EXPOSED MOLDED LATCHES

BACKGROUND OF THE INVENTION

1. Field of the Invention

This invention is related to electrical connectors and especially to electrical connectors that have molded latches forming a part of a molded connector housing. These molded latches serve as primary retention members to secure electrical terminals or contacts in the housing. This invention is also related to electrical connector assemblies that uses a mechanical assist, such as a lever, to overcome large mating forces between connectors having a large number of mating terminals or contracts mounted in two mating connectors.

2. Description of the Prior Art

Crimp snap terminals are commonly used in mating electrical connectors that employ a large number of mating terminals. These terminals are first crimped to wires that may be part of an electrical harness, and the terminals are then inserted into cavities in a molded connector housing. Many of these conventional crimp snap terminals have metal tangs or lances protruding from the terminal. These tangs or lances are deflected as the terminals are inserted into the housing cavities, and the lances then snap back to their normal position engaging a surface on the connector to secure the terminals in the housing cavities after they have been completely inserted. In many applications, such as automotive and motor vehicle assemblies, these protruding metal lances pose problems. The protruding lances can become snagged on the wires causing difficulties during assembly, or the lances can be damaged so that they do not adequately retain the terminal in the housing. When two connectors are mated, and mating force between terminals can then dislodge improperly seated terminals.

An alternative to the use of metal lances is to mold resilient plastic latches as part of the molded electrical connector housing. These molded latches are typically located on one side of the housing cavities in which the terminals are positioned. When the terminals or contacts are inserted, each plastic latch is separately deflected outwardly to permit the terminal to move to its fully seated position. When the terminal is fully seated, the plastic latch can return to its neutral position where it will engage a shoulder or and edge of the terminal to retain the terminal during mating. In many of the connectors of this type, a gap is formed between the plastic latches and an adjacent housing wall, typically an outer housing wall. The adjacent wall then serves as a back-up preventing excessive deflection of the molded latch, either during terminal insertion or removal. Often a separate terminal position assurance member is then inserted into the gap between the wall and the molded latch. This terminal position assurance member can only be inserted into this gap if the terminal has been fully inserted allowing the molded latch to return to its normal position. However, the need to provide a back-up wall and a gap to provide space both for latch deflection and for insertion of a terminal position assurance member results is a larger connector by increasing the height of the housing.

Some prior art electrical connectors have eliminated the outer back up wall from the housing and have placed the molded latches on an external surface of the connector housing. Representative examples of this approach are shown in U.S. Pat. No. 4,891,021 and in U.S. Pat. No. 4,984,998. However, to prevent excessive deflection of the molded latches and overstressing of the plastic, these prior art connectors have still employed overstress projections which limit outward deflection of the molded latches. These overstress projections can also add height to the connector housing unless they do not extend beyond connector latches or other structures located on the exterior of the housing. However, when the sides of the connector are otherwise free of projecting structures, these overstress projections increase the size and height of the connector. The size of the opening or pocket in which the connector is to be located is thereby affected, or the spacing on which the connectors are to be mounted is adversely affected.

Another prior art approach that has been employed to back-up molded latches located on the exterior of the housing is to use an outer shell that fits over the external latches and is usually inserted over the mating end of the housing or from the side. This shell can protect the molded latches when the connector is in use, but they can only be assembled after the terminals have been fully inserted. The shells therefore serve as a terminal position assurance member, but they do not function as a back-up or anti-overstress member to protect the molded latches during terminal insertion or removal. These outer shells also add another layer with a resultant increase in the height and size of the electrical connector assembly.

One application in which the height or lateral dimension of an electrical connector is important is when the connector must be mated in a shroud or shield, especially one having a standard or predetermined size. For example, U.S. Pat. No. 5,322,448 discloses am electrical connector having a lever actuated mechanism for mating a connector containing receptacle contacts to a pin header. That connector includes an outer shroud or shield to which a lever mechanism is attached. An electrical connector is fitted into a pocket in the shroud and the lever engages a rack on a mating pin header to simplify mating two multi-position electrical connectors. Although not included in that disclosure, the electrical connector, with which that assembly is used, employs contacts having metal lances to secure the contact in the connector housing cavities. However. as previously discussed that configuration requires less space than a conventional connector employing molded plastic contact retention latches.

SUMMARY OF THE INVENTION

One of the objects of this invention is to provide an electrical connector that can fit into a shroud of a lever actuated connector assembly that is conventionally employed with terminals having metal contact retention lances. This invention employs molded contact retention lances in a shroud or shield that is substantially the same size as the prior art shroud.

This invention also provides for overstress prevention by limiting the deflection of the plastic latch without including structure that increases the height or lateral dimension of the connector housing.

Another object successfully achieved by this invention is to include anti-overstress protection for molded latches in a connector housing that can be efficiently molded.

These and other objects of this invention are accomplished by an electrical connector that includes multiple electrical contacts located within cavities in a molded housing. The housing has molded cantilever resilient latches to retain the contacts in corresponding cavities. Each latch is deflectable to permit insertion of the contact and to permit extraction of the corresponding contact. The electrical connector has a stop shoulder on a distal end of each cantilever latch and an opposed shoulder on the housing adjacent the latch distal end. The stop shoulder engages the opposed shoulder to prevent overstressing of the molded cantilever latches when deflected to disengage the corresponding contact. Both the shoulders are located on the mating end of the housing. The latch includes a frame on the distal end which defines a portion of the cavity entrance which receives a pin in a mating header when this connector is mated to the header. The stop shoulder on the latch is preferably located on the side of the latch.

This connector can be used in an electrical connector assembly that also includes an outer shroud. The electrical connector is positioned within the outer shroud. The shroud includes a lever engagable with a mating connector to apply a mating force to mate the electrical connectors. The housing includes the deflectable molded latches on opposed external sides of the housing. The opposed stop means on the latches and the housing prevent excessive deflection of the latches so that, by positioning the deflectable molded latches on opposed external sides of the housing, the distance between opposed external sides of the housing is reduced to fit within a shroud pocket so that the electrical connector assembly is reduced in size.

BRIEF DESCRIPTION OF THE DRAWINGS

FIG. 11 is a sectional view of the lever shroud housing in which the electrical connector shown in FIGS. 1–10 can be positioned.

FIG. 12 is a sectional view of a mating electrical connector or header to which the electrical connector comprising the preferred embodiment of this invention is to be mated.

DETAILED DESCRIPTION OF THE PREFERRED EMBODIMENT

Figure 1:
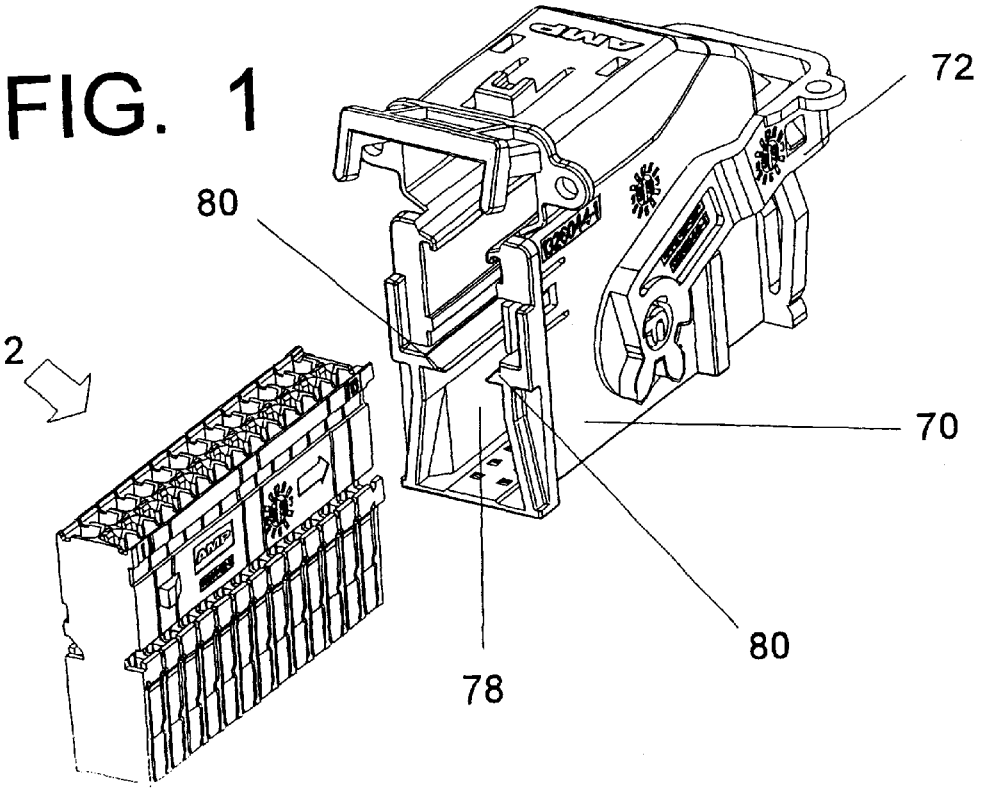
FIG. 1 is a view of an assembly including an electrical connector and a lever activated shroud or shield for mating the electrical connector to a mating electrical connector or header.
Figure 3:
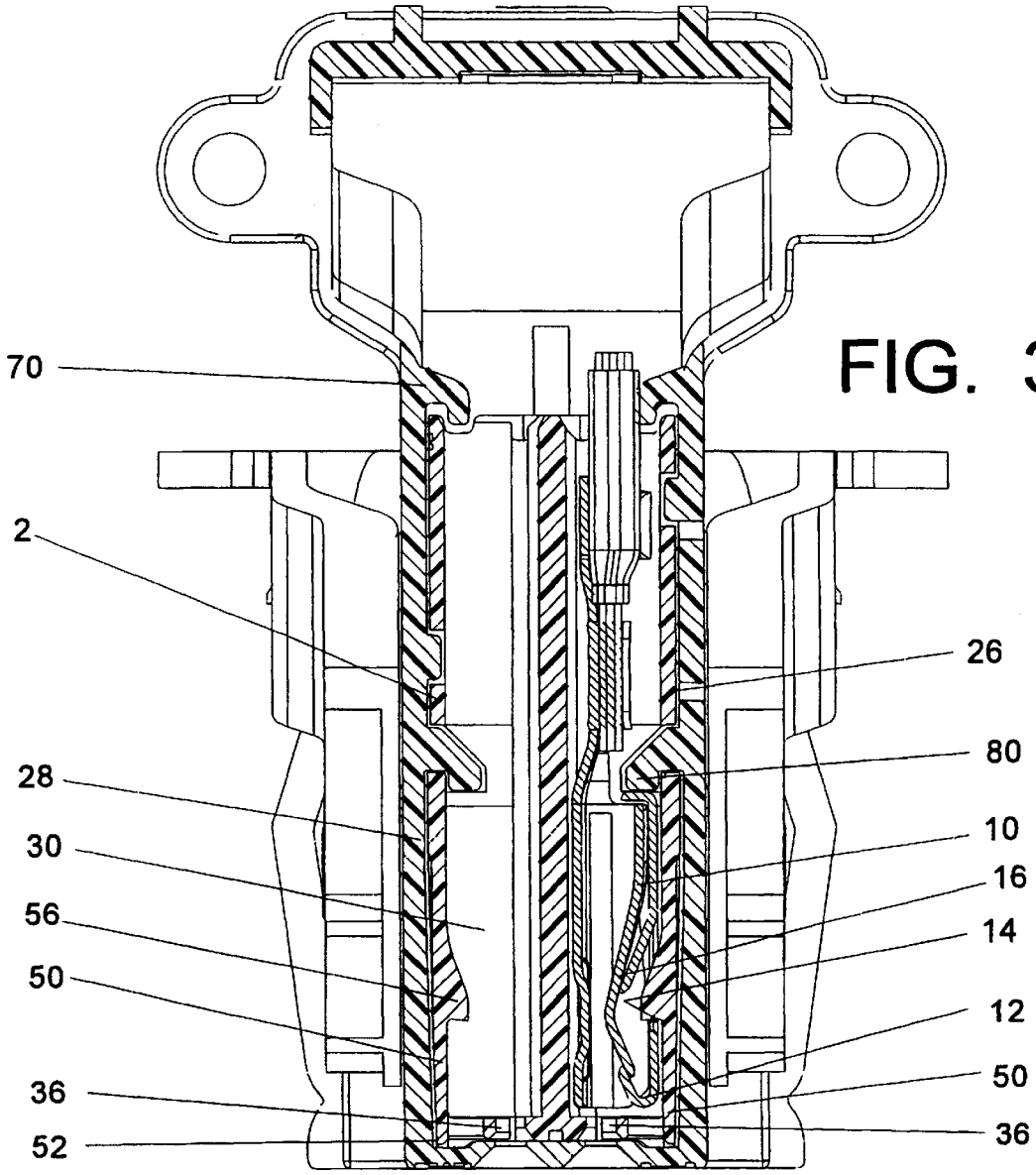
FIG. 3 is a sectional view showing single contact positioned in one of the housing cavities in the electrical connector.

FIG. 1 shows an electrical connector assembly comprising a receptacle connector 2 which can be inserted into an outer shroud 70 so that the electrical connector 2, here containing twenty-six contacts or terminals 10 shown in FIG. 3, can be mated with a mating connector, such as the header 4 shown in FIG. 12. The shroud 70 includes a lever 72 that engages a rack 8 on header 4 to mate the contacts 10 with header pins 6. U.S. Pat. No. 5,322,448 shows a lever action connector of the same basic configuration as that depicted herein and the disclosure of that patent is incorporated herein by reference.

The contacts or terminals 10, employed in electrical connector 2, are crimped to the ends of wires and then inserted into terminal cavities 30 in the molded housing 20. These wires are partially shown in FIG. 3, and the wires are crimped to the terminals in a conventional manner. The contacts 10 have a mating socket 12 located at one end with a latch opening 14 located along one side of the contact. The mating socket 12 includes a spring beam 16, which is backed up by another beam, in the stamped and formed contact. A contact of this type is described in more detail in U.S. Provisional Patent Application 60/136,719, filed May 28, 1998, which is assigned to the assignee of this application and is incorporated herein by reference.

The molded housing 20, as shown in FIGS. 2–5, has two rows of housing cavities 30 into which the contacts 10 are inserted through a rear face 24 toward a housing mating face 22. Each cavity 30 extends from the rear face 24 to the mating face 22. The molded housing 20 has a generally rectangular cross section with laterally extending opposite housing sides 26 forming external side faces 28 which are interrupted by slots defining molded cantilevered resilient primary contact latches 50 that form a portion of the external side faces 28. These latches 50 comprise the primary latches that each secure a corresponding contact 10 in a corresponding housing cavity 30.

Figure 6:
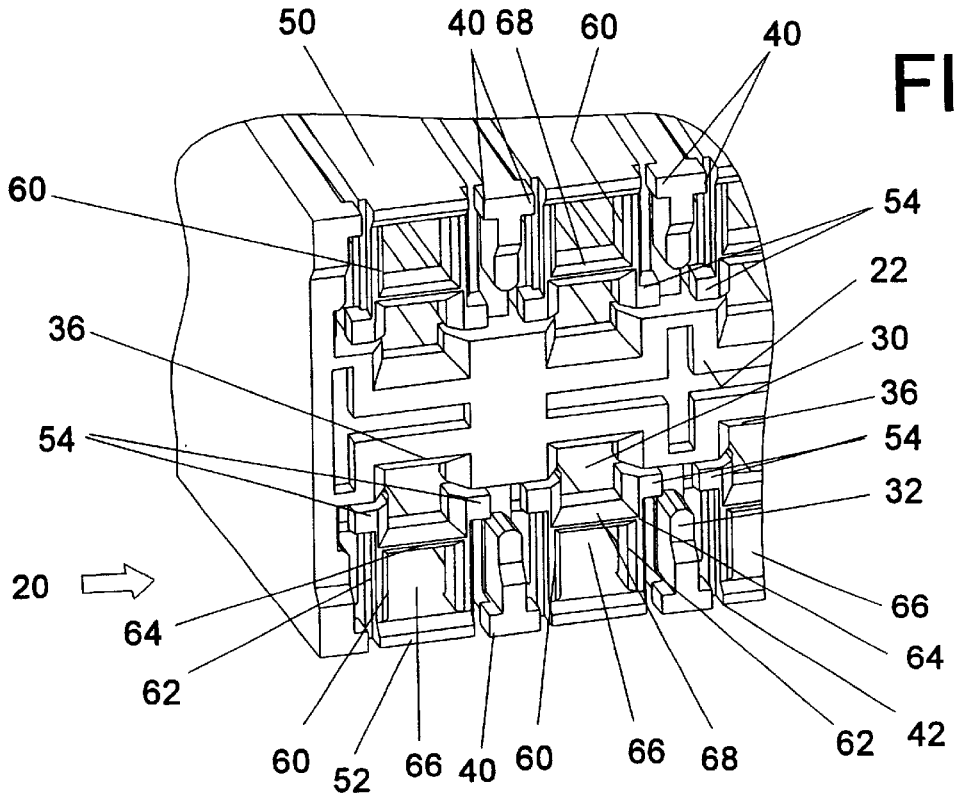
FIG. 6 is a partial three dimensional view of the mating face of the electrical connector housing showing the distal ends of the molded cantilever contact latches.

Each of the cavities 30 has an open cavity entrance 36 located at the distal end of the cavity on the connector mating face 22. For the twenty-six position connector 2 depicted herein, two rows of cavities 30 are formed with two rows of cavity entrances 36 located inwardly of the molded latches 50. As shown in FIG. 6, openings 66 are formed adjacent each cavity entrance 36, between the cavity 30 and the external side face 28 of the injection molded connector housing 20.

Figure 7:
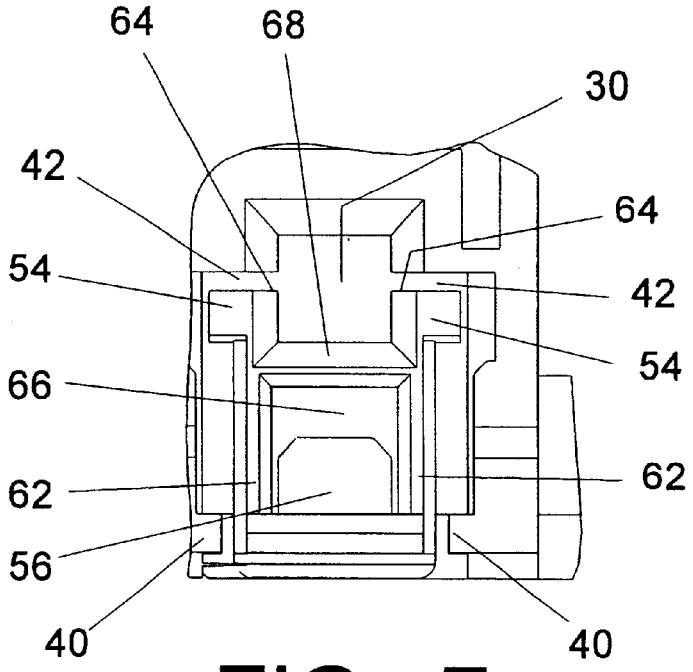
FIG. 7 is a front view showing one terminal cavity and one of the contact latches located adjacent the cavity.

As best shown in FIGS. 6 and 7 housings stop shoulders 40 are located at the outer corners of each housing cavity entrance 36 on the housing mating face 22. Each cavity entrance 36 is dimensioned and positioned for receipt of a header pin 6 when the connector 2 is mated to the mating header 4, shown in FIG. 12. Each cavity entrance 36 includes beveled edges for aligning or gathering the pins when the two connectors are mated.

Figure 2:
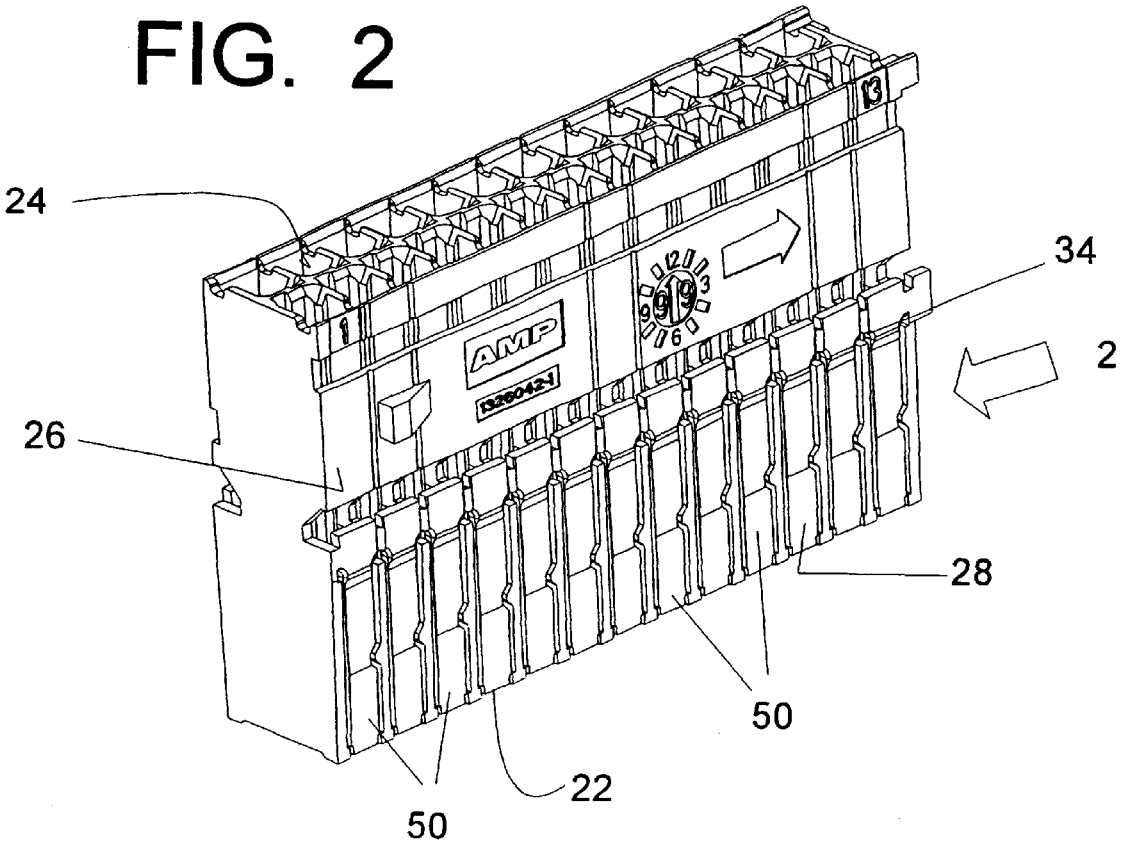
FIG. 2 is a view of the electrical connector housing.
Figure 4:
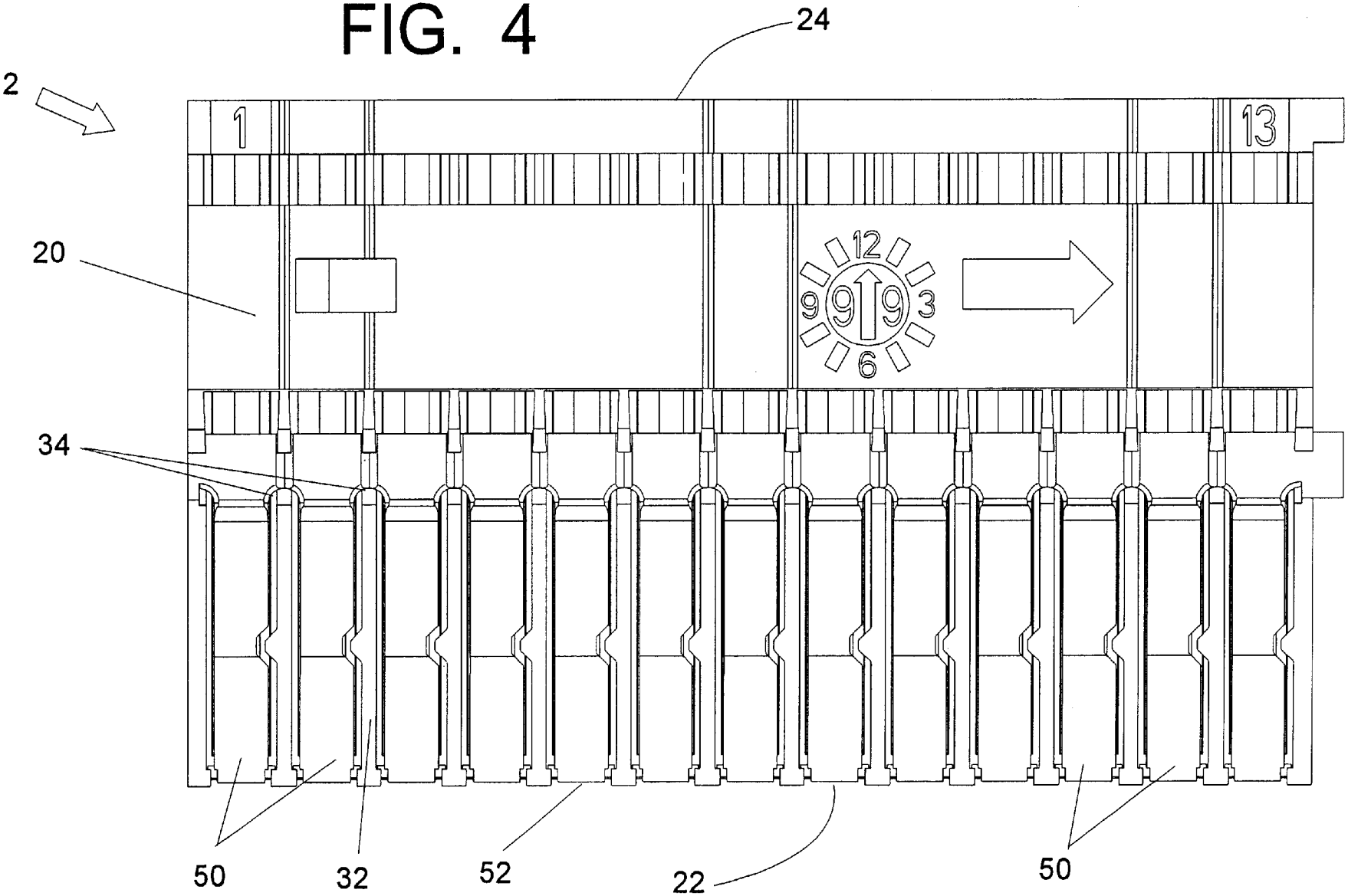
FIG. 4 is a plan view of the electrical connector housing showing the molded cantilever contact latches exposed on a top face or side of the connector housing.
Figure 5:
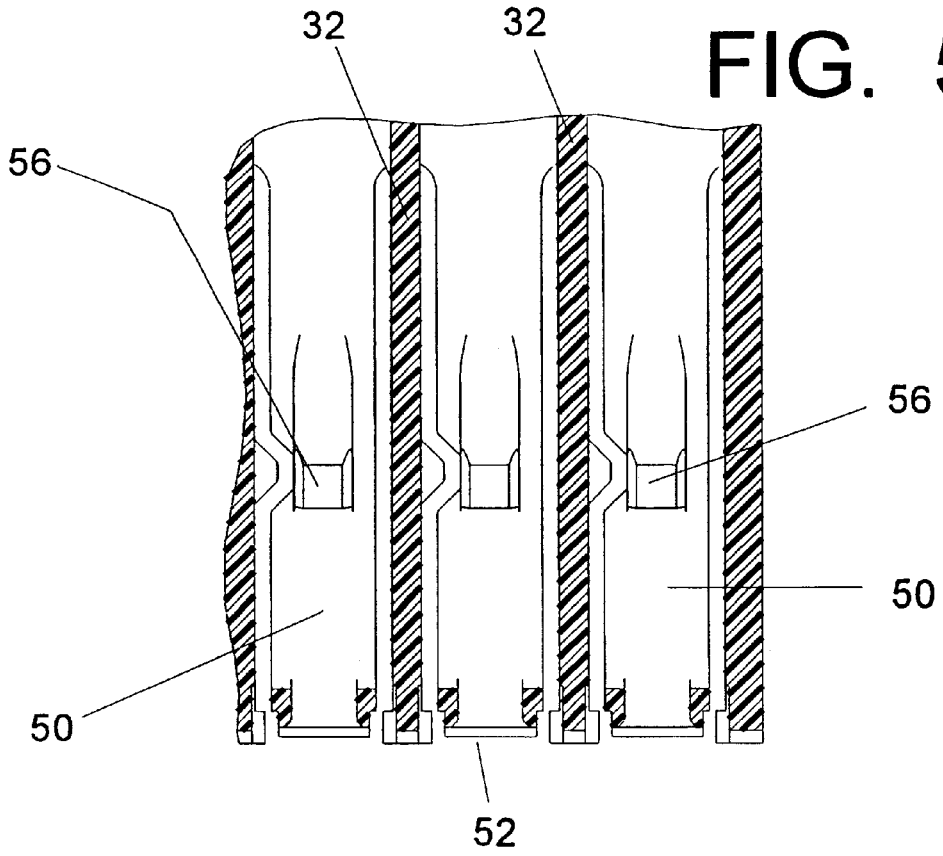
FIG. 5 is a partial sectional view showing the interior surface of three molded contact latches in three adjacent contact cavities.
Figure 8:
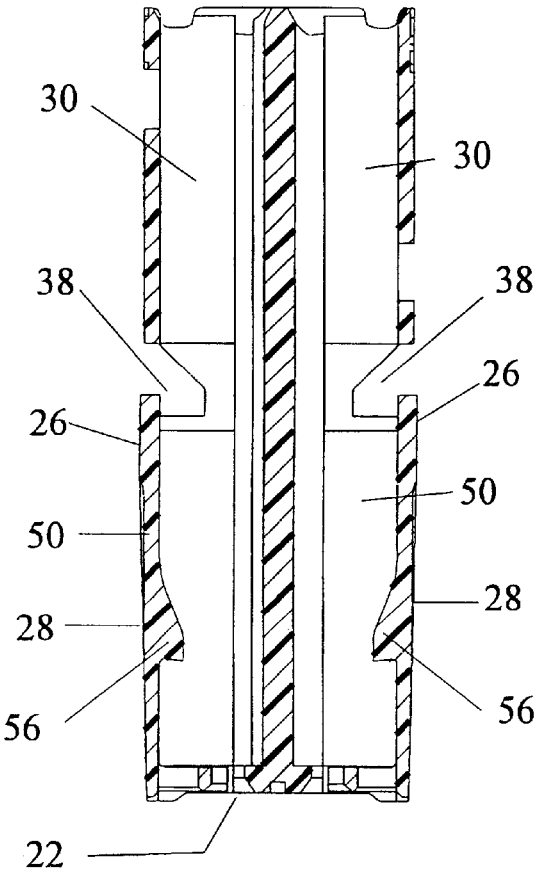
FIG. 8 is a sectional view showing two adjacent cavities on opposing sides of the connector housing and showing two contact latches on opposite exposed sides of the housing.
Figure 9:
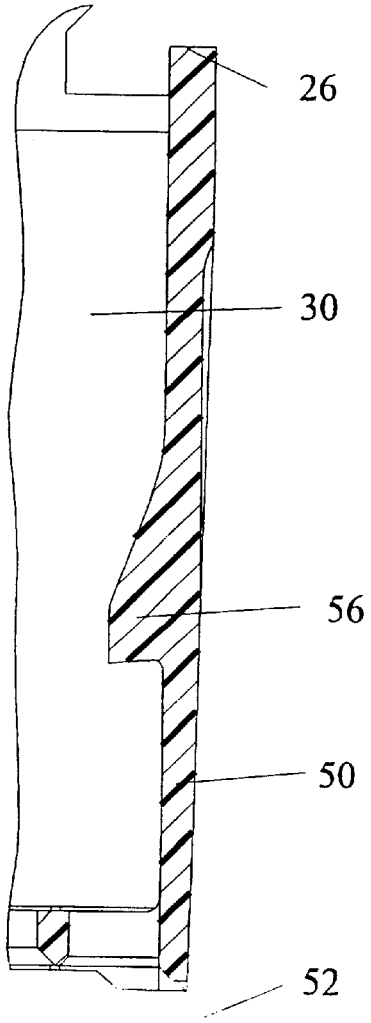
FIG. 9 is a sectional view of one of the molded cantilever contact latches that comprise the primary latching means for securing the contact in the housing.
Figure 10:
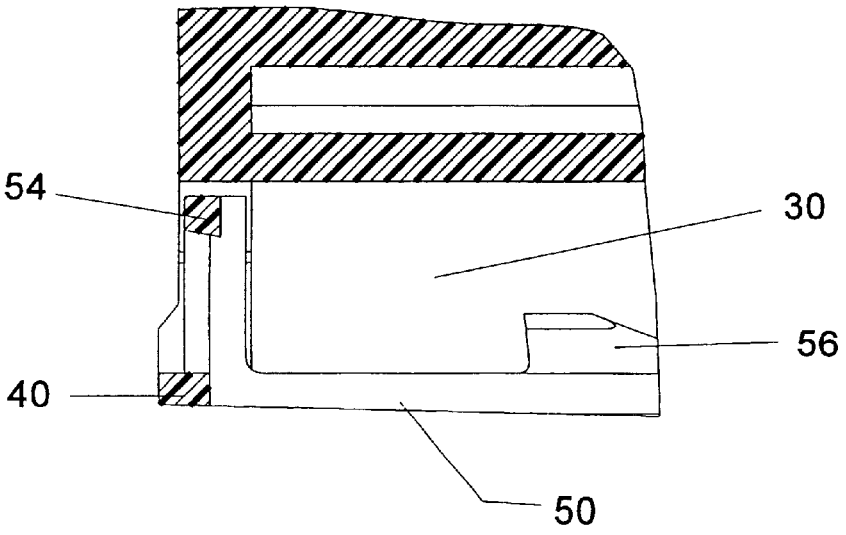
FIG. 10 is a sectional view showing the distal end of one of the contact latches.

The molded cantilever latches 50 form an outer side wall of the corresponding cavity 30. The rear end of each latch 50 is integral with the external side face 28 on which it is formed. The latches 50 are integral portions of the injection molded housing 20. The free or distal end 52 of each latch 50 is located along the housing mating face 22, and a rectangular frame 60 which is formed at the latch distal end 52 forms part of the mating face 22 and forms a portion of each corresponding cavity entrance 36. A step or an inwardly projecting primary contact stop 56 having a shape suitable for receipt in contact latch opening 14 and is located on each latch 50 between the fixed rear end of latch and the latch distal or forward end 52. See FIGS. 3, 8 and 9. As shown in FIGS. 2 and 4, a full radiused contour 34 extends between adjacent exposed latches 50 at the base of each latch. Although these complete curved surfaces extend into the housing at the rear of the latches, and reduce the amount of material in forming the housing, lower stresses and stronger latches nevertheless result from this structure.

The latch 50 is resilient and is deflectable when a contact 10 is inserted from the rear into the corresponding cavity 30. During insertion of the contact 10, the forward end of the contact will engage the latching step 56 and deflect the latch outward. Further forward movement of the contact 10 will bring the contact latch opening 14 into alignment with the latch step or catch 56 at which point the latch 50 will return to its normal configuration or neutral state shown in FIGS. 1–10. In this position the outside of the latch 50 is in the same plane as the external side face 20 so that the latch 50 does not protrude beyond the normal mating envelope defined by the housing 20. In other words, the connector 2 can be received within the shrouded header 4 shown in FIG. 12.

In order to prevent excessive deflection of the molded cantilever latch 50, either during insertion of a contact 10 or during removal of a contact 10 from a cavity 30, stop shoulders 54 are located on the latch distal end 52. Shoulders 54 are therefore positioned to engage fixed opposed stop shoulders 40 located on the housing mating face 22 adjacent the sides of each corresponding latch 50. See FIGS. 6, 7 and 10. The latch stop shoulders 54 extend beyond the sides of the latch 50 so that the latch shoulders 54 are aligned with the fixed opposed stop shoulders 40 so that the shoulders will abut upon sufficient outward deflection of the corresponding latch 50. The travel of the latch distal end 52 and the latch stop shoulders 54 is chosen so that the latch 50 will not be deflected beyond a point at which the latch 50 will be overstressed or damages. Abutting stop shoulders 54 and 40 thus serve as anti-overstress means. In other conventional electrical connectors employing molded contact latches, an outer wall of the housing serves as a backup preventing excess deflection of the latches, but this outer wall adds to the height or size of the connector, especially for two row connectors with two outer walls. By positioning the stop shoulders 54 and 40 on the distal ends of the latch 50 and housing 20, or at the mating face, these outer walls can be eliminated and the height or lateral dimension of the connector will be less than for a conventional connector housing. Stops 40 and 54 each extend from side surfaces that are themselves transverse to the latch external faces 28.

The latch stop shoulders 54 located at the latch distal end 52 are formed at the two innermost corners 64 of a open rectangular frame 64 located on the latch distal end 52. This frame 60 includes two side columns 62 extending inwardly from the latch 50 and joining a top arm 68 extending between the inner corners 64 and the shoulders 54. This top arm 68 and the inner edges of the shoulders 54 form the outer portion of each cavity entrance 36. The top arm 68 has a beveled edge for pin alignment during mating. A frame central opening 66 is aligned with the latch step 52 so that the frame does not overlap the latch step 52. This configuration can be molded by two oppositely extending portions of an injection mold, both of which extend along the axis of the housing cavity 30, so that side pull tooling is not necessary to mold the latches 50. The frame 60 is separated from cavity side walls 32 by slits 42 that are located along the sides of the cavity entrances 36, but which are not large enough to allow pins 6 to enter the slits 42 during mating. See FIG. 6. The frame opening 66 also provides space for insertion of a tool that can be used to pry or outwardly deflect the corresponding latch 50 to release the contact 10 if for any reason the contact or terminal 10 is to be removed from its housing cavity 30 or for continuity checking.

When all of the contacts 10, with wires crimped to the contacts, are inserted into the housing 20, the connector 2 can be inserted through an end opening 78 of the shroud pocket 74, shown in FIGS. 1, 3 and 11. Ridges 80 on the inside of the shroud are received in grooves 38 on the outer sides 26 of the connector 2 when the connector 2 is inserted into the shroud or shield 70. If all of the contacts or terminals 10 are properly inserted into the corresponding housing cavities 30, the terminals will occupy the position shown in FIG. 3 and the ridges 80 will be fit behind the contact mating socket sections 12 of all of all of the terminals. However, if any of the contacts 10 are not fully inserted, the ridge 80 will abut the mating section 12 of that partially inserted terminal, preventing complete insertion of connector 2 in the shroud 70. The shroud or shield 70 and the ridges 80 on the shroud interior surfaces thus serve as a terminal position assurance member, or TPA. A flexible snap on the inside of the shroud 70 engages a laterally extending arm on the housing 20 to secure the connector 2 in the shroud or shield 70. When the connector 2 is properly positioned with the shroud 70, the connector assembly is aligned with the mating header 4, and the lever 72 is rotated. Teeth on the lever engage the header rack 8 to draw the two mating connectors together and properly mate the male and female contact terminals.

Although the stop shoulders used in the instant invention are intended to reduce the height of the connector so that it can fit within a smaller shroud, this invention can be employed in many other applications in which limiting the height of the connector is either required or desirable. For example, the latch stop configuration used herein could also be used to allow multiple connectors to be mounted side by side and mated with pin terminals located in an equally spaced array. Since there is no need for a protruding structure on the exterior of the connector housing to back-up the molded latches, the adjacent exterior sides can be flush so that the spacing between adjacent rows of pins need not be irregular. This approach could also be used in an electrical connector with multiple housing rows in which one row of molded latches is located on a external surfaces, but the other latches are internal to the structure and face in the same in direction as the exposed latches, instead of facing in the opposite direction as in the preferred embodiment. Adjacent single row connectors incorporating this molded latch configuration could also be mounted side by side of constant centerline spacings in this manner. Other applications would be apparent to one of ordinary skill in the art, and the subject matter of the invention is defined by the following claims and is not limited to the representative embodiment shown herein.

We claim:

1. An electrical connector including multiple electrical contacts located within cavities in a molded housing, the housing having a mating face at which the electrical connector is mateable with a mating electrical connector, the housing including molded cantilever resilient latches engaging corresponding contacts to retain the contacts in corresponding cavities, each latch being deflectable to disengage the corresponding contact, the electrical connector being characterized by a stop shoulder on each cantilever latch adjacent a distal end of the cantilever latch and an opposed shoulder on the housing adjacent the distal end of each cantilever latch, the stop shoulder and the opposed shoulder being located on the mating face, the stop shoulder engaging the opposed shoulder to prevent overstressing of the molded cantilever latches when deflected to disengage the corresponding contact.

2. The electrical connector of claim 1 wherein each stop shoulder is located on the distal end of the corresponding cantilever latch and the opposed shoulder is located adjacent a distal end of each corresponding cavity.

3. The electrical connector of claim 1 wherein the molded cantilever latches are exposed on at least one side of the housing.

4. The electrical connector of claim 1 wherein the stop shoulders are located on columns extending inward away from an adjacent side face of the housing.

5. The electrical connector of claim 4 wherein a step extends inwardly on each latch, the step engaging the contact located in the corresponding cavity, the stop shoulders being located inwardly, from an adjacent housing side face, beyond the step.

6. The electrical connector of claim 1 wherein each cantilever latch includes a rectangular frame located on the distal end, the stop shoulders being located at corners of the rectangular frame.

7. The electrical connector of claim 6 wherein the rectangular frame has a central opening.

8. The electrical connector of claim 7 wherein a step extending inwardly from the latch and spaced from the distal end is aligned with the central opening of the frame so that a front surface of the step can be molded by mold tooling extending through the central opening.

9. The electrical connector of claim 1 wherein each stop shoulder extends from a side surface of the corresponding cantilever latch, each side surface extending transverse relative to an exposed side of the housing.

10. An electrical connector comprising a plurality of contacts positioned in cavities extending inwardly from a mating face of a molded housing, the housing including deflectable molded cantilever latches for securing contacts within cavities, the latches including latch stop shoulders on the housing mating face, engagable with fixed shoulders on the housing to prevent excessive deflection of the molded cantilevered latches.

11. The electrical connector of claim 10 wherein the latch stop shoulders are formed on frame members located on distal ends of the molded cantilever latches.

12. The electrical connector of claim 11 wherein the frame members and the stop shoulders form a portion of an entrance to each cavity on the housing mating face.

13. The electrical connector of claim 11 wherein each frame includes an open center located adjacent the entrance of a corresponding cavity.

14. The electrical connector of claim 11 wherein a slit is located between the frame and cavity side walls of each adjacent corresponding cavity.

15. The electrical connector of claim 10 wherein each molded cantilever latch forms a portion of an adjacent external side wall of the housing to reduce a lateral dimension of the electrical connector.

16. The electrical connector of claim 15 wherein each molded cantilever latch includes an inwardly projecting primary contact stop engagable with a corresponding contact to secure the corresponding contact in the corresponding housing cavity.

17. The electrical connector of claim 16 wherein each latch is outwardly deflectable during insertion of the corresponding contact into the corresponding cavity, the latch stop shoulder engaging the corresponding fixed shoulder on the housing to prevent the molded deflectable latch from being overstressed during insertion of the corresponding contact into the corresponding cavity.

18. An electrical connector assembly comprising an electrical connector including terminals located in cavities in a molded housing and an outer shroud, the electrical connector being positioned within the outer shroud, the shroud including a lever engagable with a mating connector to apply a mating force to mate the electrical connectors, the housing including deflectable molded latches on opposed external sides of the housing and opposed stop means on the latches and the housing to prevent excessive deflection of the latches so that, by positioning the deflectable molded latches on opposed external sides of the housing, the distance between opposed external sides of the housing is reduced to fit within a shroud pocket so that the electrical connector assembly is reduced in size.

19. The electrical connector assembly of claim 18 wherein the should pocket is open on one end, the electrical connector being insertable endwise through the open end into the shroud pocket.

20. The electrical connector assembly of claim 18 wherein the electrical connector housing includes a groove and the shroud includes a ridge received within the groove when all of the terminals are fully inserted into corresponding cavities, a partially inserted terminal obstructing the groove to pervent receipt of the ridge in the groove so that the shroud ridge comprise terminal position assurance means.

21. An electrical connector including multiple electrical contacts located within cavities in a molded housing, the housing including side by side molded cantilever resilient latches engaging corresponding contacts to retain the contacts in corresponding cavities, each latch being deflectable to disengage the corresponding contact, each latch being exposed on a side of the housing with stop surfaces on the housing and on the latch to prevent excessive deflection of the latch, each latch having a curved surface connecting a base section of each latch to a base section of an adjacent latch, thereby reducing stress in the housing adjacent the base section when the latches are deflected.

* * * * *